United States Patent [19]

Campagnuolo et al.

[11] 3,946,637

[45] Mar. 30, 1976

[54] MORTAR WITH VARIABLE VENT FOR ADJUSTING VELOCITY OF A SINGLE CHARGE CARTRIDGE

[75] Inventors: Carl J. Campagnuolo, Potomac; Paul A. Curto, Bethesda, both of Md.

[73] Assignee: The United States of America as represented by the Secretary of the Army, Washington, D.C.

[22] Filed: Oct. 17, 1973

[21] Appl. No.: 407,391

[52] U.S. Cl. ..... 89/1 F; 89/1.703

[51] Int. Cl.[2] ..... F41F 1/06

[58] Field of Search ..... 89/1, 1 F, 1.703; 42/1 R

[56] References Cited

UNITED STATES PATENTS

| | | | |
|---|---|---|---|
| 1,559,183 | 10/1925 | Rimaicho | 89/1 F |
| 2,417,983 | 3/1947 | Holman et al. | 89/1 F |
| 2,986,973 | 6/1961 | Waxman | 89/1.703 |
| 3,307,451 | 3/1967 | Bucklisch et al. | 89/1.703 |
| 3,628,415 | 12/1971 | McElroy | 89/1 F |

*Primary Examiner*—David H. Brown

*Attorney, Agent, or Firm*—Nathan Edelberg; Robert P. Gibson; Saul Elbaum

[57] ABSTRACT

A variably adjusted vent communicates with the interior of a mortar tube. By adjusting the vent setting, the velocity of a single charge cartridge can be varied. In one embodiment of the invention, the vent discharge is exhausted below the base plate of the mortar to stabilize the mortar during firing.

4 Claims, 12 Drawing Figures

MORTAR WITH VARIABLE VENT FOR ADJUSTING VELOCITY OF A SINGLE CHARGE CARTRIDGE

RIGHTS OF THE GOVERNMENT

The invention described herein may be manufactured, used, and licensed by or for the U.S. Government for governmental purposes without the payment to us of any royalty thereon.

BRIEF DESCRIPTION OF THE PRIOR ART

Present mortars use various powder bags to achieve different muzzle velocities. The mortar such as the 81 mm mortar has nine charges plus a zero charge. These 10 charges allow the muzzle velocity to vary from 210 ft/sec (charge zero) to 856 ft/sec (charge nine). In order to obtain any required muzzle velocity, the mortarman must physically remove one or more charges prior to firing. The propellant is contained in burnable bags that are apt to absorb moisture in a wet environment. When wet, the propellant will not fully burn. This shortcoming prohibits the projectile from achieving the intended range of the trajectory.

Various approaches in the prior art have included the utilization of a variable vent to permit adjustment of chamber pressure in a mortar tube during firing which would affect muzzle velocities and range. Such examples of the prior art are U.S. Pat. Nos. 2,417,983, 1,559,183, 31628,415, 3,730,050.

BRIEF DESCRIPTION OF THE INVENTION

The present invention utilizes a variable vent in the mortar tube which may, preferrably be used in conjunction with a one charge cartridge.

The one charge mortar contains a single hermetically sealed charge which is located within the base of the projectile and which can provide the maximum muzzle velocity (for the 81 mm martar, 856 ft/sec.). The muzzle velocity of this new system can be varied by exhausting some of the combustion gases from the base of the mortar tube. The mass of exhausted gases determines the muzzle velocity. The gas mass control can be achieved by a sliding mechanism which the mortarman operates prior to firing. Indentations or markings may be provided on the tube so that, by positioning the setting lever on the appropriate mark, the exhaust slot is opened such that the desired muzzle velocity is achieved.

In one embodiment of the present invention, the vented discharge is exhausted below the base plate portion of the mortar. Thus, during firing, a reaction force on the base plate will occur that counteracts the recoil forces from the discharged cartridge. This balancing effect stabilizes the mortar during firing.

The above-mentioned objects and advantages of the present invention will be more clearly understood when considered in conjunction with the accompanying drawings, in which:

DETAILED DESCRIPTION OF THE INVENTION

Figure 1:
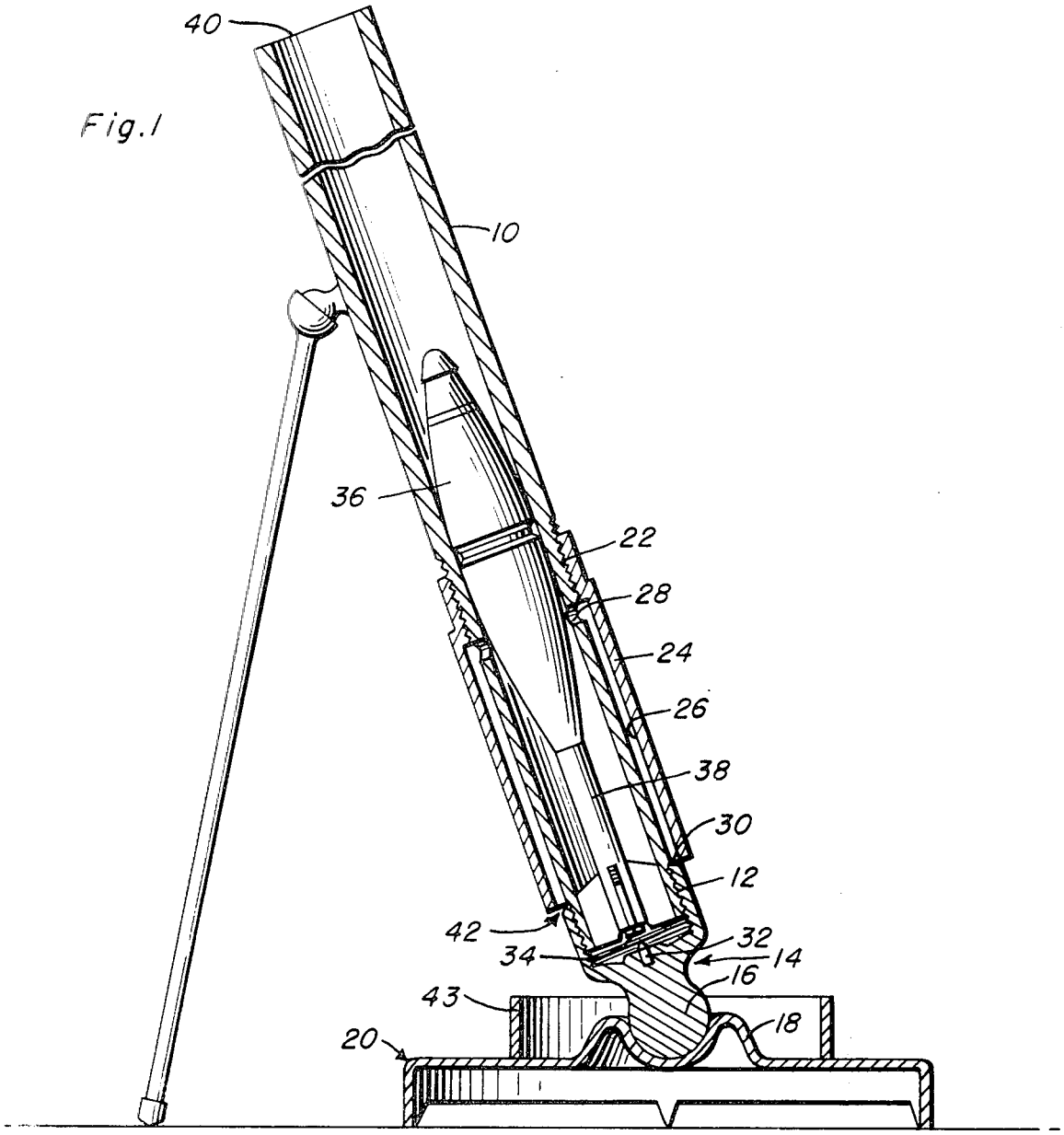
FIG. 1 is a sectional view taken through a mortar showing the disposition of a one charge cartridge therein. This represents a first embodiment of the invention.

Referring to the Figures, and more particularly FIG. 1 thereof, reference numeral 10 denotes an elongated mortar tube which is threaded at 12 to an end cap, generally indicated by reference numeral 14. At the downward end of the end cap is a ball 16 which fits into a mating socket 18 to allow positioning of the mortar. The socket forms a part of the base plate 20 that is positioned against the ground before firing. An intermediate section 22 of the mortar tube is also threaded so that an outer sleeve or tube 24 may be threaded thereon. An annular passageway exists between the mortar tube 10 and the outer sleeve 24. This passageway guides the exhaust of gas downwardly, as will be explained hereinafter. A plurality of radially spaced ports or opening 28 are formed in the mortar tube 10 to permit the bleeding or exhaust of gas from the inside of the mortar tube to the annular passageway 26. The downward end of the passageway 26 serves as an adjustable nozzle or vent, as indicated by reference numeral 30.

In operation of the device illustrated, a single charge mortar cartridge 36 is dropped into the mortar tube 10. Contact is made between the pin 32 extending upwardly into the mortar tube 10 from the end cap 14. The pin contacts a primer charge 34 in the cartridge and causes it to set off a single charge 38 that is disposed within the tail assembly of the cartridge 36. The charge 38 is hermetically sealed within the cartridge 36 so that it is not affected by moisture. As the charge is actuated, the pressure builds up in the base of the mortar tube 10. The purpose of the adjustable vent or nozzle 30 is to permit the bleeding of some of this gas pressure out of the mortar tube so that the muzzle velocity of the cartridge may be selected. The path for gaseous discharge through the vent includes the openings 28, passageway 26, and the opening at 30. By rotating the mortar tube 10, relative to the outer sleeve 24, the interface at 42 is adjusted to effect nozzle action. In one limit position, the interface is complete so that no venting can take place. In the other limit position, the confronting surfaces of the mortar tube 10 and the end cap 14 separate considerably at the interface 42. This permits a substantial venting effect. By adjusting the venting, a mortarman can select the muzzle velocity of the cartridge 36 as the cartridge 36 leaves the muzzle 40 of the mortar tube 10. An annular deflector shield 43 is mounted to the upper surface of the base plate 20 to deflect the vented discharge directed downwardly from 42.

The downward direction of the vented discharge is of particular advantage. In effect, this vented discharge is a high velocity reaction jet which exerts reaction forces in the upward direction to counter the recoil forces exerted by the fired cartridge. Thus, the excess energy, derived from the reaction jet helps to reduce recoil and stabilizes the mortar during firing.

Figure 2:
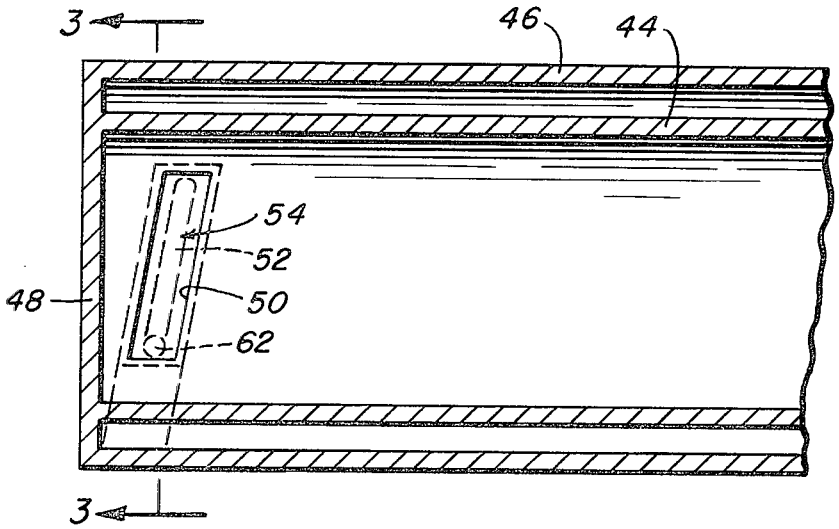
FIG. 2 is a partial sectional view through a mortar having inner and outer tubes. Venting occurs between the inner tube and the annular space between the tubes. This Figure represents a second embodiment of the invention.
Figure 3:
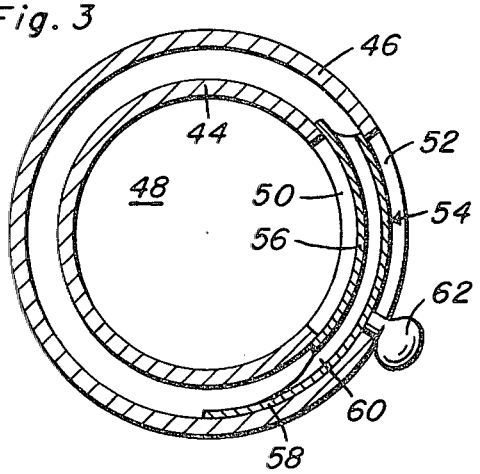
FIG. 3 is a sectional view taken along a plane passing through section line 3—3 of FIG. 2.

FIG. 2 illustrates a second embodiment of the present invention which illustrates a different type of venting arrangement. A mortar tube 44 is concentrically surrounded by an outer tube 46. Both tubes are joined along a common base 48. An annular passageway exists between the mortar tube 44 and the outer tube 46. As shown in FIGS. 2 and 3, an exhaust slot or opening 50 is formed along an arc of the mortar tube 44. A second slot 52 is formed in the outer tube 46. The slot 50 is illustrated as being a parallelogram that is angularly disposed relative to the base 48. The slot 52 guides a handle 62 which adjusts the extent to which the exhaust slot 50 is exposed. The angular orientation of the slot 52 permits a more convenient manual movement of the handle by a mortarman when the mortar is upwardly inclined during use. The valve or regulator for the exhaust slot 50 is the sliding vent valve generally indicated by reference numeral 54. This valve assembly includes a first component 56 which resembles a segment of a brakeshoe. The purpose of this component is to adjustably uncover the exhaust slot 50 thus permitting more or less gaseous venting of the mortar tube during firing. The valve assembly 54 includes a second component 58, similar to the component 56. However, the component 58 has a larger radius and larger length. A rib 60 connects the components 56 and 58. FIGS. 2 and 3 show the exhaust slot 50 in a closed position. Thus no venting will occur. This is the position selected when maximum velocity is desired. It might also be mentioned that suitable rollers or bearings may be connected to the valve assembly 54 to allow a more effortless adjustment of the handle 62. The slot 52 may also include detents so that a mortarman may "feel" the various positions of the handle as he changes them. Alternately, gradations may be inscribed along the slot 52 to correlate handle position with the velocity.

Figure 5:
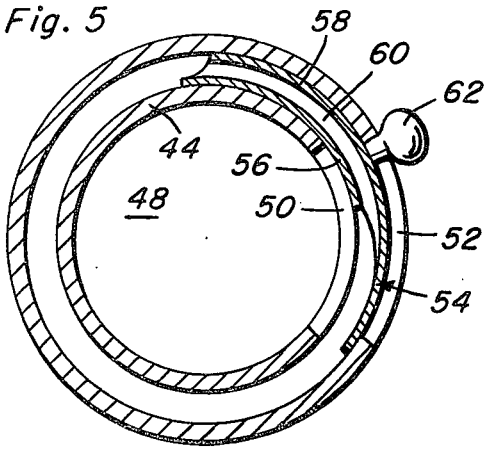
FIG. 5 is a cross sectional view taken along a plane passing through Section line 5—5 in FIG. 4.
Figure 4:
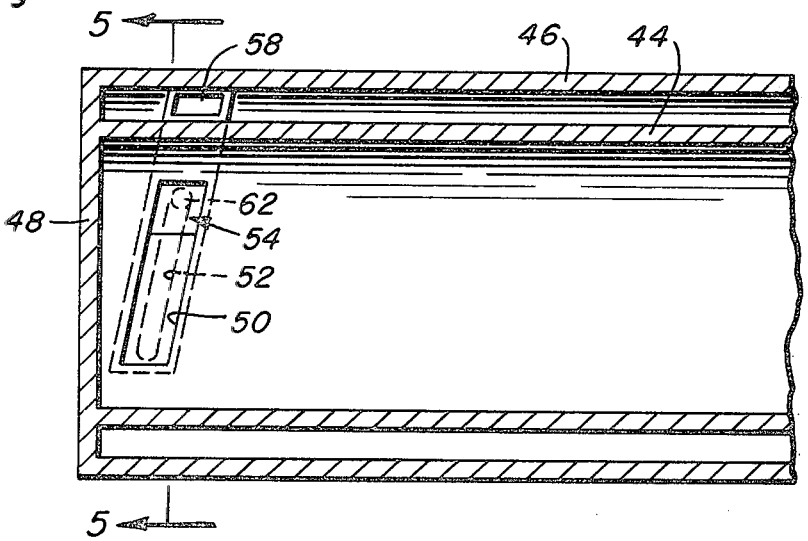
FIG. 4 is a partial sectional view, similar to that of FIG. 2, except that the components are illustrated in a vent open position instead of a closed vent position, as shown in FIG. 2.

FIGS. 4 and 5 illustrate the disposition of the handle 62 and the valve assembly 54 in an open position. In this position the cartridge dropped into the mortar will experience minimum muzzle velocity.

In operation of the embodiment shown in FIGS. 2–5, venting will occur along a path including the exhaust slot 50, the angular passageway between the mortar tube 44 and the outer tube 46, which terminates at the outward end of the mortar.

Figure 6:
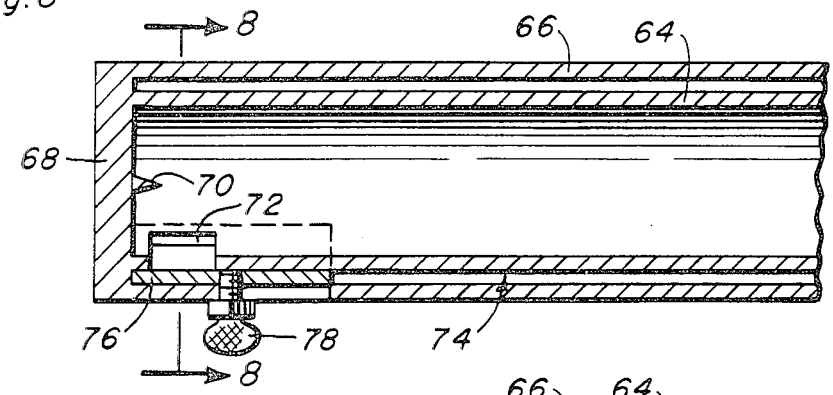
FIG. 6 is a partial sectional view of a double walled mortar that has a simply actuated sliding valve for achieving adjustable venting action. The vent is shown in the closed position. This is a third embodiment of the invention.
Figure 7:
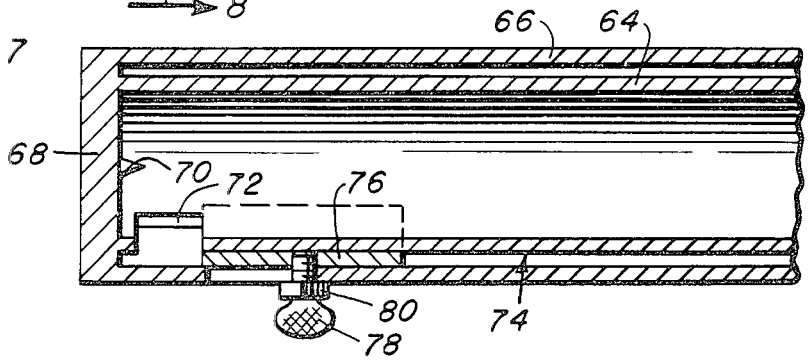
FIG. 7 is a view similar to that of FIG. 6, except with the vent shown open.
Figure 8:
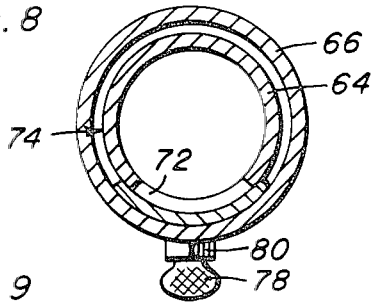
FIG. 8 is a view taken along a plane passing through section line 8—8 in FIG. 6.

A third embodiment of the present invention is indicated in FIGS. 6–8. This third embodiment is similar to the second embodiment except for the structure of the valve mechanism at the vent. As indicated in FIG. 6, there is a mortar tube 64 that is outwardly surrounded by a concentrically disposed tube 66. An annular passageway exists between these tubes. The tubes are connected at the lower ends thereof by a unitary base 68. Pin 70 extends from the base and engages a primer of a cartridge when the cartridge is dropped into the mortar.

A rectangular exhaust slot 72 is formed at the base end of the mortar tube. The annular passageway between the mortar and outer tubes is denoted by reference numeral 74. A curved sliding member 76 is positioned by an integrally connected handle 78 to adjust the opening of the exhaust valve 72. In FIG. 6, the slider member 76 is shown in a position which completely closes the exhaust slot 72 thus insuring maximum muzzle velocity. By moving the handle 78 upwardly, the slider member 76 uncovers the exhaust slot to permit the venting of discharge gas therethrough. When the gas is discharged through the exhaust slot, it circulates evenly around the passageway 74 and flows upwardly until it is finally exhausted from the upper end of the passageway, at the muzzle. A lock nut or similar fastener 80 is positioned at the handle 78 so that a preselected position of the handle can be locked into place. As in the case of the previous embodiment, detents may be provided for preselected velocity positions. Gradations may also be inscribed for a continuous indication of velocity.

Figure 11:
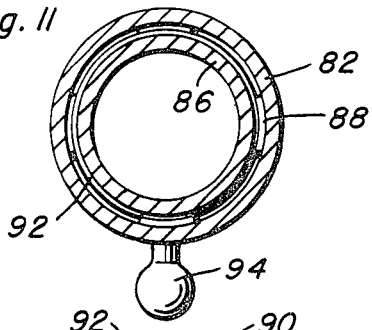
FIG. 11 is a sectional view taken along a plane passing through section line 11—11 in FIG. 10.
Figure 9:
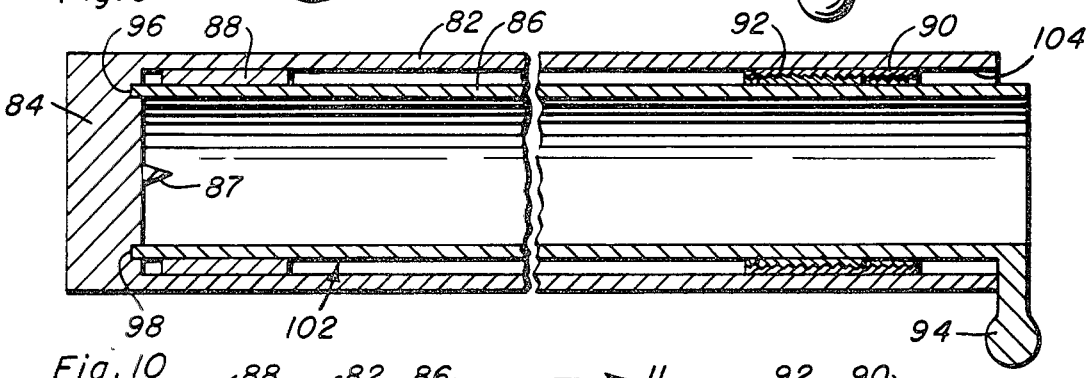
FIG. 9 is a sectional view of a doubled wall mortar which achieves venting by moving an inner mortar tube relative to the outer tube. This represents a fourth embodiment of the invention.
Figure 10:
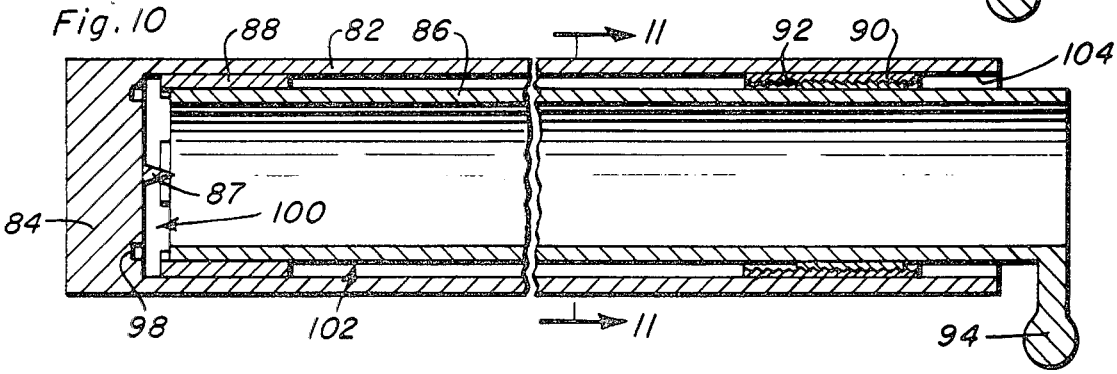
FIG. 10 is a view similar to that of FIG. 9 but illustrating a space created between the inner and outer tubes that permit venting. The disposition between the inner and outer tubes, as shown in FIG. 9, illustrate a closed vent condition.

FIGS. 9–11 illustrate a fourth embodiment of the present invention. An outer tube 82 concentrically surrounds a radially inward mortar tube 86. The outward tube is integrally connected with the base 84. However, the mortar tube 86 is slidably positioned within the outer tube 82 and may be moved into and out of engagement with the base 84. A plurality of circularly spaced guide ribs 88 may be positioned between the tubes 86 and 88 to lend structural rigidity. A plurality of circularly spaced threaded ribs 90 are positioned at the opposite end of the mortar and serve the dual function of rigidifying the structure as well as permitting longitudinal adjustment of the mortar tube, relative to the outer tube. The threaded interface between the tubes is indicated by 92. A hand crank 94 is integrally connected to the outer end of the mortar tube and extends radially outwardly for easy manipulation by a mortarman. By revolving the hand crank 94, the longitudinal position of the mortar tube is adjustable, relative to the outer tube.

FIG. 9 illustrates the mortar in a position whereat there is no venting of gas discharge from the mortar tube 86. The vent, in effect, constitutes the inward end 96 of the mortar tube, used in conjunction with an annular seat or groove 98 which receives the adjacent end of the mortar tube. However, when venting is desired, the hand crank 94 is rotated thereby displacing the end 96 of the mortar tube out of the seat 98.

In operation of the embodiment illustrated in FIGS. 9–11, with the mortar tube positioned as shown in FIG. 10, a passageway 100 is created whereby gas may be discharged from the interior of the mortar tube, along passageway 100, and finally through the annular passageway 102, for final exhaust at the outward end 104 of the passageway.

Figure 12:
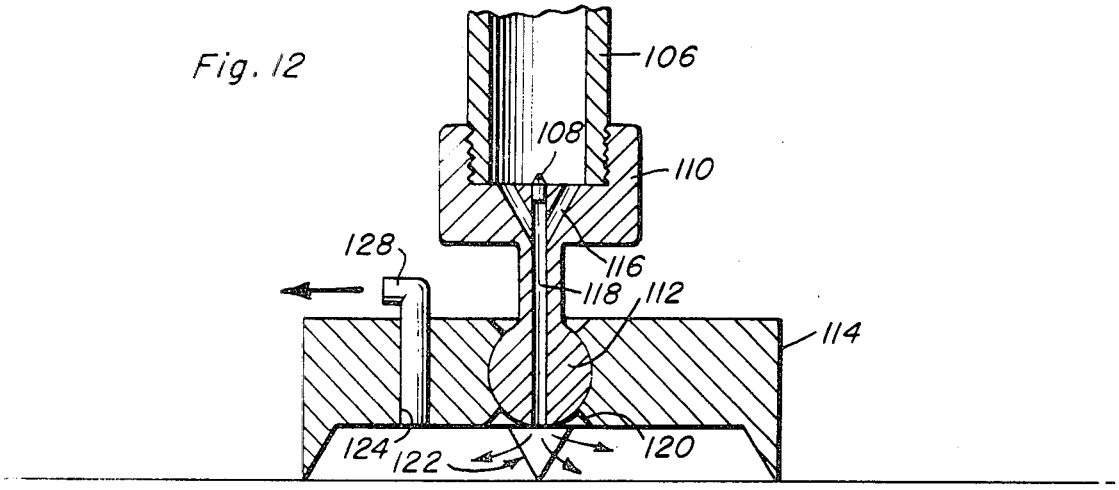
FIG. 12 is a partial sectional view, particularly illustrating the end cap and ball joint of a mortar. Venting between the mortar parts is illustrated whereby vented discharge is exhausted below the base plate of the mortar to stabilize the mortar during firing. This Figure represents a fifth embodiment of the invention.

The final embodiment of the invention is illustrated in FIG. 12. The basic purpose for the design of the mortar, as shown in FIG. 12, is for the purpose of reducing recoil thus stabilizing the mortar during firing. In this respect, the embodiment of FIG. 12 achieves the same goals as the first mentioned embodiment of FIG. 1. As will be noted in the figure, the mortar tube 106 is threaded into an end cap 110 which terminates in an integrally connected ball 112. The ball is received within a socket in base plate 114.

In operation of the embodiment of FIG. 12, a cartridge is dropped into the mortar tube 106. The firing pin 108 sets off the cartridge in the usual manner. A number of symmetrically positioned passageways 116 communicate with the lower end of the mortar tube. The passageways 116 feed into a central passageway 118 that extends through the end cap 110 and the ball portion 112. The socket of the base plate 114 is cut away at 120 to permit exhaust of gases through the end of passageway 118, as denoted by 122. Discharge is then exhausted to the atmosphere as shown. As the discharge occurs, a reaction jet is produced, as in the case of the FIG. 1 embodiment. As a result, the reaction force diminishes the effect of recoil during cartridge firing. Base plate 114 has an additional passageway 124 formed therein so that the exhausted gas may be directed from underneath the base plate 114 to the atmosphere at gas release port 128. The passageway formed in the body of the base plate 114 is indicated by reference numeral 126.

The embodiment of FIG. 12 is shown in a simple form. It is to emphasized that a valve of any suitable type is preferably connected in the exhaust path to adjust the exhaust flow which results in a variably selectable muzzle velocity. Accordingly, the embodiment of FIG. 12 may be combined with the vent designs of previous embodiments, or other suitable alternatives to permit this adjustability.

It should be understood that the invention is not limited to the exact details of construction shown and described herein for obvious modifications will occur to persons skilled in the art.

What is claimed is:

1. A mortar device comprising:

a mortar tube for receiving a cartridge, the tube having an exhaust slot formed therein;

a second tube radially larger that the mortar tube surrounding the mortar tube and creating an annular passageway between the tubes;

arcuate vent valve means positioned in the passageway for sliding displacement over the slot to adjust exposed slot area which communicates with the passageway; and means connected to the the valve means for moving the valve means to a selected position corresponding to a predetermined exposed slot area;

thereby permitting the exhaust of cartridge gas from the mortar tube to the atmosphere, via the slot and passageway.

2. The subject matter of claim 1 together with a single charge cartridge received in the mortar tube capable of achieving maximum muzzle velocity when the valve means completely closing the exhaust slot.

3. The subject matter of claim 1 wherein the vent valve means comprises:

a first arcuate member located in the annular passageway and disposed in sliding juxtaposition with the mortar tube;

a guide slot formed in the second tube for receiving the valve moving means;

a second arcuate member located in the annular passageway and disposed in sliding juxtaposition with the second tube for covering the guide slot and preventing gas exhaust therefrom;

means connecting the first and second arcuate members for linking the motion therebetween.

4. The subject mattar as set forth in claim 1 wherein the vent valve means comprises:

an arcuate member located in the annular passageway and disposed in sliding juxtaposition with the mortar tube for adjustably covering the exhaust slot, the width of the arcuate member being substantially as wide as the width of the annular passageway;

a guide slot formed in the second tube;

handle means located in the guide slot and connected to the arcuate member for selectively positioning the arcuate member over the exhaust slot.

* * * * *